US006741043B2

(12) United States Patent
Prasad

(10) Patent No.: US 6,741,043 B2
(45) Date of Patent: May 25, 2004

(54) BALLAST WITH ADAPTIVE END-OF-LAMP-LIFE PROTECTION

(75) Inventor: Himamshu V. Prasad, Rolling Meadows, IL (US)

(73) Assignee: Osram Sylvania, Inc., Danvers, MA (US)

( * ) Notice: Subject to any disclaimer, the term of this patent is extended or adjusted under 35 U.S.C. 154(b) by 0 days.

(21) Appl. No.: 10/261,011

(22) Filed: Sep. 30, 2002

(65) Prior Publication Data

US 2004/0061455 A1 Apr. 1, 2004

(51) Int. Cl.[7] ..... H05B 37/00

(52) U.S. Cl. ..... 315/307; 315/224

(58) Field of Search ..... 315/224, 225, 315/291, 307, 219, 312, 318, 324, 209 R, 308

(56) References Cited

U.S. PATENT DOCUMENTS 5,869,935 A * 2/1999 Sodhi ..... 315/225
6,362,575 B1 * 3/2002 Chang et al. ..... 315/224
6,366,032 B1 * 4/2002 Allison et al. ..... 315/307

* cited by examiner

*Primary Examiner*—Wilson Lee
(74) *Attorney, Agent, or Firm*—Kenneth D. Labudda

(57) ABSTRACT

A ballast (100) having an inverter (110,120,122) and a direct current blocking capacitor (130) coupled in series with a ballast output (108) includes a control circuit (140) for providing adaptive end-of-lamp-life protection. During operation, control circuit executes the steps of measuring (208) and storing (210) a reference value for the voltage across the DC blocking capacitor (130), monitoring (308, 310) the voltage across the DC blocking capacitor (130), and protecting (312) the inverter and lamp sockets in response to the voltage across the DC blocking capacitor departing from the reference value by more than a predetermined threshold amount.

6 Claims, 3 Drawing Sheets

BALLAST WITH ADAPTIVE END-OF-LAMP-LIFE PROTECTION

FIELD OF THE INVENTION

The present invention relates to the general subject of circuits for powering discharge lamps. More particularly, the present invention relates to a ballast with adaptive end-of-lamp-life protection.

BACKGROUND OF THE INVENTION

In electronic ballasts with a half-bridge type inverter and a direct-coupled output, it is common for a direct current (DC) blocking capacitor to be coupled in series with the lamp. During normal operation of the lamp, the voltage across the DC blocking capacitor ($V_{BLOCK}$) is equal to approximately one-half of the DC rail voltage ($V_{DC}$) that is supplied to the inverter. As the lamp approaches the end of its normal operating life, $V_{BLOCK}$ will tend to depart from its normal value of about $V_{DC}/2$. Thus, a number of existing end-of-lamp-life protection circuits monitor $V_{BLOCK}$ as a reliable indicator of imminent lamp failure. A number of these circuits consider a lamp to be in a failure mode when $V_{BLOCK}$ departs from its normal value by more than a predetermined threshold amount.

In order to adequately protect the ballast from damage and avoid any possible overheating of the lamp sockets (the latter being a primary concern with small diameter lamps, such as T5 lamps), it is highly desirable that the predetermined threshold amount be suitably small in relation to the normal value of $V_{BLOCK}$. As an example, in a ballast with $V_{DC}$=450 volts, the normal value of $V_{BLOCK}$ is about $V_{DC}/2$=225 volts. A typical protection circuit will consider the lamp to be in the failure mode if $V_{BLOCK}$ departs from its normal value of 225 volts by as little as 10 volts (i.e., 4%) in either direction; that is, the lamp is considered to be in the failure mode if $V_{BLOCK}$ either exceeds 235 volts or falls below 215 volts. In existing protection circuits, these minimum (i.e., 215 volts) and maximum (i.e., 235 volts) values are "designed in"; that is, they are specified on an a priori basis, regardless of the actual value of $V_{BLOCK}$ during normal operation.

The problem with setting such a tight band of detection (e.g., ±4%) on an a priori basis is that the tolerances of certain components in the ballast render such an approach unreliable at best. First, $V_{BLOCK}$ is generally monitored via a resistive voltage-divider network that is coupled in parallel with the DC blocking capacitor. The tolerances of the voltage-divider resistors are a first source of possible error. Secondly, the protection circuit itself generally includes a digital control circuit or microcontroller in which the supply voltage ($V_{CC}$) can vary by as much as 5%. This introduces another possible source of detection error. Additionally, small differences in the dead-time and/or duty cycle at which the inverter switches are driven will cause $V_{BLOCK}$ to differ at least somewhat from its ideal normal value of $V_{DC}/2$. Also, $V_{DC}$ itself has an associated tolerance (e.g., typically on the order of about 2% or so). Finally, each of the aforementioned sources of possible error is temperature-dependent to some extent, and may thus be aggravated by the often considerable changes in temperature that occur during operation of the ballast.

In order to avoid the detection problems arising from component tolerances, one would have to set a band of detection that is considerably less tight than in the above example. For instance, the band of detection would have to be increased to ±20 volts (rather than ±10 volts). Unfortunately, such "opening up" of the band of detection degrades the quality of protection afforded by the protection circuit, and may not even be an option for ballasts that operate certain types of lamps.

What is needed, therefore, is a ballast with an end-of-lamp-life protection circuit that is capable of providing a tight band of detection and that is relatively insensitive to component tolerances and other sources of detection error. Such a ballast would represent a considerable advance over the prior art.

DETAILED DESCRIPTION OF THE PREFERRED EMBODIMENTS

Figure 1:
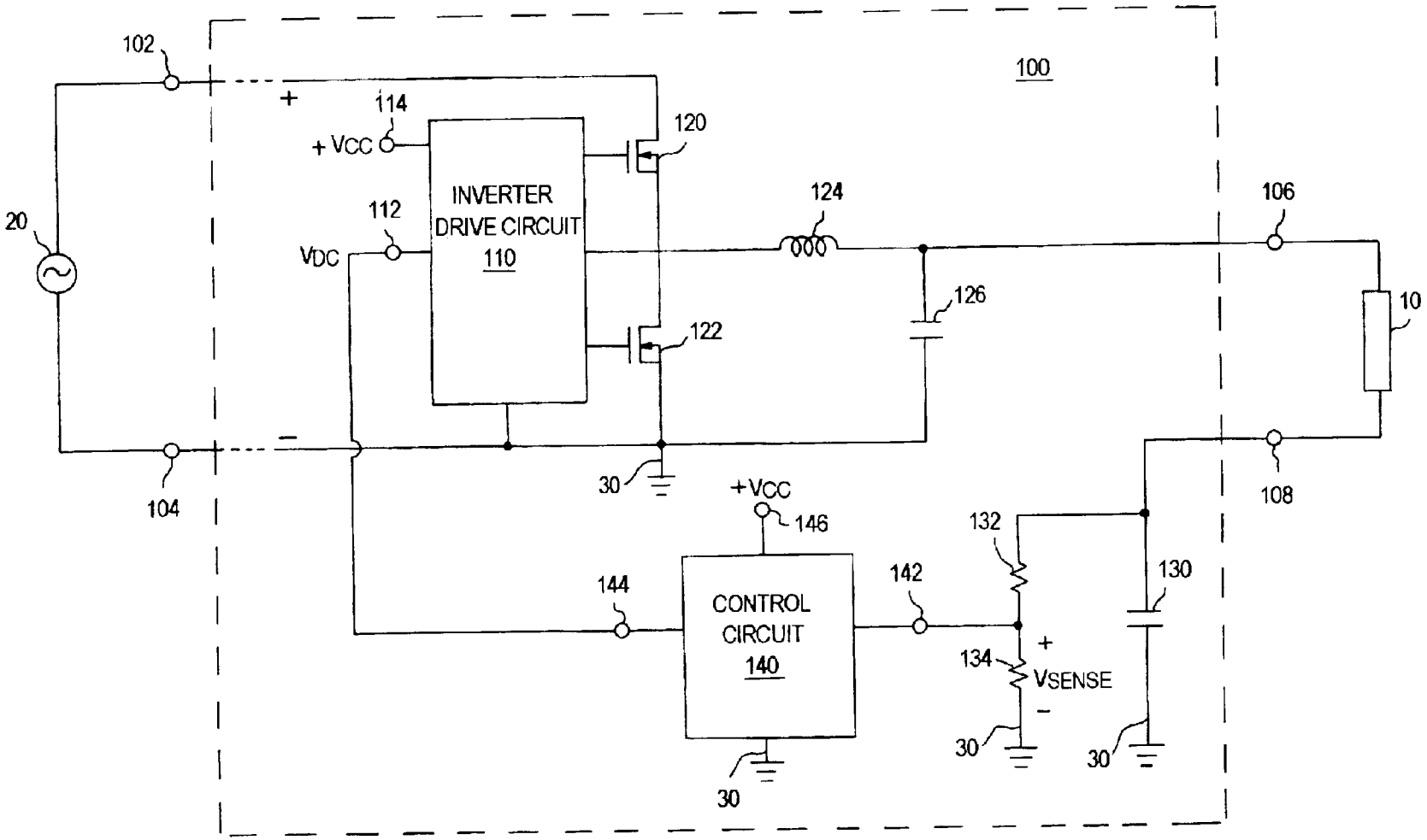
FIG. 1 describes a ballast with an end-of-lamp-life protection circuit, in accordance with a preferred embodiment of the present invention.

A ballast 100 for powering at least one gas discharge lamp 10 is described in FIG. 1. Ballast 100 comprises a pair of input connections 102,104, first and second output connection 106,108, an inverter 110,120,122 with a series-resonant output circuit 124,126, a direct current (DC) blocking capacitor 130, and a control circuit 140.

Input connections 102,104 are adapted to receive a source of alternating current, such as 277 volts (rms) at 60 hertz. Output connections 106,108 are adapted for connection to gas discharge lamp 10. Direct current (DC) blocking capacitor 130 is coupled between second output connection 108 and circuit ground 30.

Inverter 110,120,122 is operably coupled between input connections 102,104 and first output connection 106, and includes an inverter drive circuit 110 for providing switching of inverter transistors 120,122 at a predetermined operating frequency. Inverter drive circuit 110 has a supply input 114 for receiving operating power ($+V_{CC}$), and a protection input 112. In response to application of a fault signal at protection input 112, inverter drive circuit 110 takes protective action (e.g., terminating inverter switching or operating the inverter at a frequency that is substantially higher than the predetermined operating frequency) so as to prevent any damage to the inverter and the lamp sockets.

Control circuit 140 has a supply input 146 for receiving operating power (+VCC), a control input 142 that is operably coupled to DC blocking capacitor 130, and a control output 144 that is coupled to the protection input 112 of inverter drive circuit 110. Control circuit 140 is preferably implemented via a suitable programmable microcontroller that is programmed to operate in the following manner. Following initial application of power to ballast 100, control circuit 140 measures the voltage across DC blocking capacitor 130 and stores that voltage as a reference value. Following each subsequent application of power to ballast 100, control circuit 140 monitors the voltage across DC blocking capacitor 130. If the measured voltage across DC blocking capacitor 130 departs from the stored reference value by more than a predetermined threshold amount (e.g., 10 volts), control circuit 140 provides the fault signal at control output 144 (and, therefore, at protection input 112).

Because the actual voltage across DC blocking capacitor 130 is a rather high value (e.g., 225 volts), it is impractical to monitor or measure that voltage directly. Toward this end, ballast 100 further includes a resistive voltage-divider network comprising a first resistor 132 and a second resistor 134. First resistor 132 is coupled between second output connection 108 and control input 142 of control circuit 140. Second resistor 134 is coupled between control input 142 and circuit ground 30. The voltage across second resistor 134 (e.g., 2.25 volts or so under normal operation) is a scaled down version of the voltage across DC blocking capacitor 130. During operation, the voltage $V_{SENSE}$ across second resistor 134 is monitored and measured in lieu of the actual voltage across DC blocking capacitor 130. Of course, the predetermined threshold amount is scaled down by the same factor (i.e., 0.1 volts instead of 10 volts). As an example, if the actual voltage across DC blocking capacitor 130 is normally 225 volts, resistors 132,134 can be selected such that the corresponding voltage $V_{SENSE}$ across resistor 134 is 2.25 volts. Correspondingly, if the allowable variation in the voltage across DC blocking capacitor 130 is ±10 volts, then $V_{THRESH}$ should be set at 0.1 volts.

Preferably, the reference value is measured and stored with a resistive load (e.g., 800 ohms) coupled between output connections 106,108. This has the advantage of ensuring that the reference value is devoid of any asymmetry attributable to the load, and can be performed as part of the functional testing process during manufacture of the ballast. While it is possible to measure the reference value with an actual lamp (i.e., a lamp that is known to be good) coupled between output connections 106,108, this is not preferred because there is usually no guarantee that the lamp will not be in an end-of-life condition at that time.

Because the reference value is determined by an actual measurement rather than on an a priori basis, ballast 100 and control circuit 140 provide an adaptive scheme that allows for a tight band of fault detection that is devoid of any errors due to component tolerances.

Figure 2:
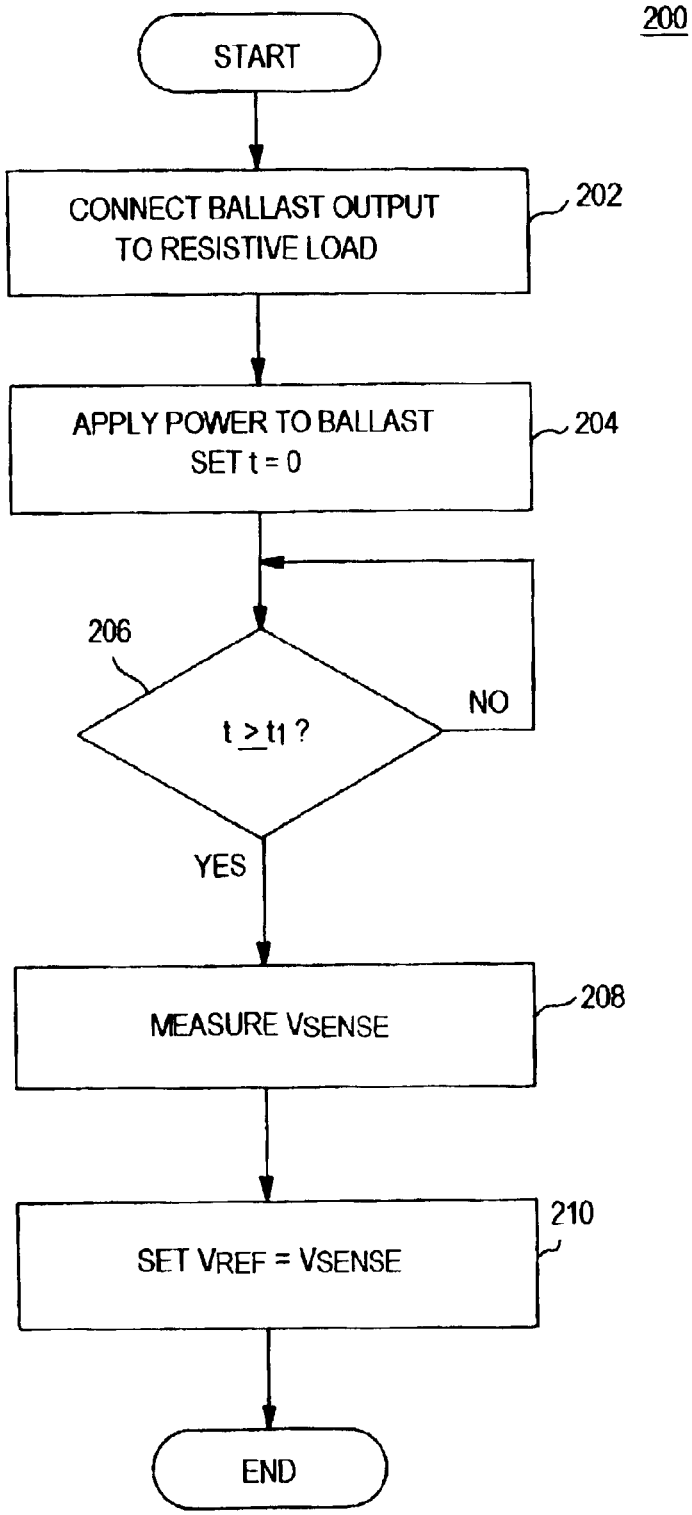
FIG. 2 is a flowchart describing the operation of the control circuit in the ballast described in FIG. 1, in accordance with a preferred embodiment of the present invention.
Figure 3:
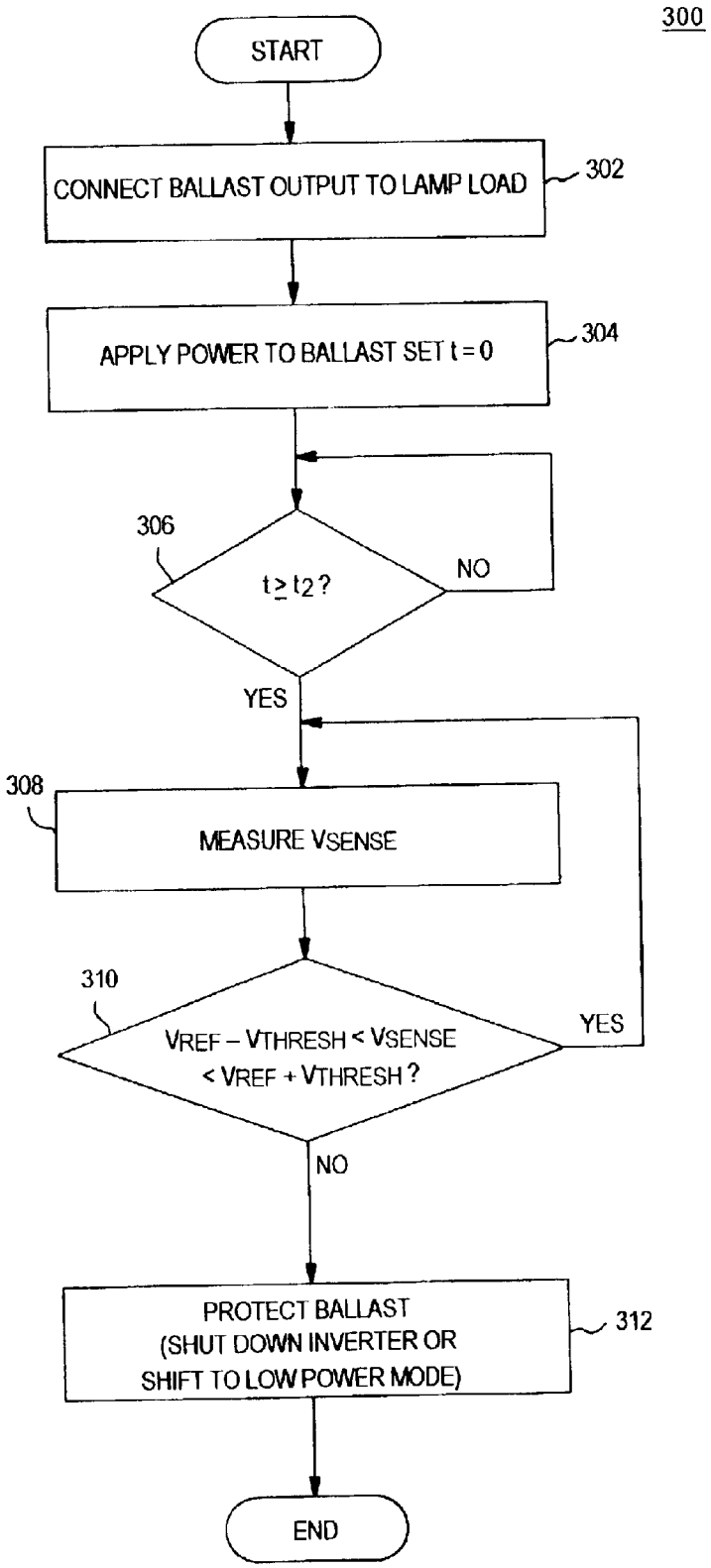
FIG. 3 is a flowchart further describing the operation of the control circuit in the ballast described in FIG. 1, in accordance with a preferred embodiment of the present invention.

Flowcharts that describe the preferred operation of ballast 100 and control circuit 140 are given in FIGS. 2 and 3.

FIG. 2 describes a preferred routine 200 by which the reference value $V_{REF}$ of the voltage across DC blocking capacitor 130 is measured and stored. At step 202, the ballast output is connected to a resistive load. At step 202, AC power is applied to the ballast. After waiting for a first predetermined period of time $t_1$ (step 206) in order to allow the ballast to achieve stable operation, the voltage $V_{SENSE}$ across the lower divider resistor (i.e., resistor 134 in FIG. 1) is measured. At step 210, the reference voltage $V_{REF}$ is set equal to the measured value of $V_{SENSE}$, and stored accordingly.

FIG. 3 describes a preferred routine 300 by which the voltage across DC blocking capacitor 130 is monitored for an end-of-lamp-life condition. At step 302, the ballast output is connected to a lamp load. At step 302, AC power is applied to the ballast. After waiting for a second predetermined period of time t2 (step 306) in order to allow the ballast to ignite the lamp and achieve stable operation, the voltage $V_{SENSE}$ across the lower divider resistor (i.e., resistor 134 in FIG. 1) is measured. At step 310, the measured value of $V_{SENSE}$ is compared with $V_{REF}$ and the predetermined threshold voltage $V_{THRESH}$. As long as $V_{SENSE}$ is within the limits assigned for normal operation, no protective action will be taken and $V_{SENSE}$ will continue to be monitored. If, on the other hand, $V_{SENSE}$ either exceeds $V_{REF}+V_{THRESH}$ or falls below $V_{REF}-V_{THRESH}$, then appropriate protective action that consists of either shutting down the inverter or shifting the inverter to a low power mode (i.e., operating the inverter at a frequency that is substantially higher than the normal operating frequency) will be taken at step 312.

Although the present invention has been described with reference to certain preferred embodiments, numerous modifications and variations can be made by those skilled in the art without departing from the novel spirit and scope of this invention. For example, the principles of the present invention are equally applicable to those ballasts wherein the DC blocking capacitor is not necessarily ground-referenced as in FIG. 1 (e.g., ballasts in which the DC blocking capacitor is coupled between resonant inductor 124 and first output connection 106).

What is claimed is:

1. A ballast for powering at least one gas discharge lamp, comprising:

a pair of input connections adapted to receive a source of alternating current;

first and second output connections adapted for connection to the gas discharge lamp;

an inverter operably coupled between the input connections and the first output connection, the inverter including an inverter drive circuit for providing inverter switching at a predetermined operating frequency, the inverter drive circuit having a protection input and being operable, in response to application of a fault signal at the protection input, to take protective action;

a direct current (DC) blocking capacitor coupled between the second output connection and circuit ground;

a control circuit having a control input operably coupled to the DC blocking capacitor, and a control output coupled to the protection input of the inverter drive circuit, wherein the control circuit is operable:

(i) following initial application of power to the ballast, to measure the voltage across The DC blocking capacitor and to store that voltage as a reference value; and (ii) following each subsequent application of power to the ballast:

(a) to monitor the voltage across the DC blocking capacitor; and (b) in response to the voltage across the DC blocking capacitor departing from the reference value by more than a predetermined threshold amount, to provide the fault signal at the control output.

2. The ballast of claim 1, further comprising:

a first resistor coupled between the second output connection and the control input of the control circuit; and a second resistor coupled between the control input of the control circuit and circuit ground.

3. The ballast of claim 2, wherein the voltage across the second resistor is monitored and measured in lieu of the voltage across the DC blocking capacitor.

4. The ballast of claim 1, wherein the predetermined threshold amount is on the order of about ten volts.

5. The ballast of claim 1, wherein the reference value is measured with a resistive load coupled between the first and second output connections.

6. The ballast of claim 1, when the inverter drive circuit is operable to protective action that includes one of:

terminating inverter switching; and operating the inverter at a frequency that is substantially higher than the predetermined operating frequency.

* * * * *